United States Patent [19]

Gilman, Jr. et al.

[11] 4,207,103

[45] Jun. 10, 1980

[54] PHOTOGRAPHIC PRINT-OUT SILVER HALIDE PROCESS

[75] Inventors: Paul B. Gilman, Jr.; Thaddeus D. Koszelak, both of Rochester, N.Y.

[73] Assignee: Eastman Kodak Company, Rochester, N.Y.

[21] Appl. No.: 918,862

[22] Filed: Jun. 26, 1978

[51] Int. Cl.[2] ..... G03C 5/04

[52] U.S. Cl. ..... 430/494; 430/461; 430/434; 430/599; 430/606; 430/644

[58] Field of Search ..... 96/45.2, 27 E, 48 QP, 96/101, 107, 63, 119 PQ

[56] References Cited

U.S. PATENT DOCUMENTS

| | | | |
|---|---|---|---|
| 2,369,449 | 2/1945 | Fallesen | 96/119 PQ |
| 3,109,737 | 11/1963 | Scott | 96/119 PQ |
| 3,178,292 | 4/1965 | Fix | 96/108 |
| 3,189,456 | 6/1965 | Hunt | 96/107 |
| 3,271,157 | 9/1966 | McBride | 96/108 |
| 3,583,870 | 6/1971 | Gilman | 96/122 |
| 3,650,758 | 3/1972 | Gilman | 96/101 |
| 3,687,676 | 8/1972 | Spence et al. | 96/101 |
| 3,703,584 | 11/1972 | Motter | 96/108 |
| 3,736,140 | 5/1973 | Collier et al. | 96/101 |
| 3,767,413 | 10/1973 | Miller | 96/107 |
| 3,772,030 | 11/1973 | Gilman et al. | 96/101 |
| 3,957,517 | 5/1976 | Ikenoue et al. | 96/119 PQ |
| 4,011,081 | 3/1977 | Gilman et al. | 96/101 |

OTHER PUBLICATIONS

*Product Licensing Index*, vol. 92, 12-1971, Item No. 9232.

*Primary Examiner*—Won H. Louie, Jr.
*Attorney, Agent, or Firm*—Richard E. Knapp

[57] ABSTRACT

A print-out image can be produced with certain internally photosensitive silver halide materials by a high intensity exposure to provide a print-out image that is resistant to background print-up under ambient illumination. The photographic silver halide material with which the process is useful comprises photosensitive silver halide grains in which the sensitivity sites where a latent image can be formed on light exposure are predominantly inside the grains. Also, at least one electron-accepting compound having a polarographic reduction potential within the range of about −0.8 volt to about −0.01 volt is required on the photosensitive silver halide in the process. The photosensitive silver halide is imagewise exposed to illumination having an intensity greater than about 3 watts per square centimeter. Following imagewise exposure, a print-out image can be observed; if the exposed element is not exposed to ambient light, the print-out image can be intensified by developing in a surface developer. If, however, the exposed element is further exposed to ambient light, the surface image is lost but the print-out image may be intensified by developing with an internal developer.

8 Claims, No Drawings

PHOTOGRAPHIC PRINT-OUT SILVER HALIDE PROCESS

BACKGROUND OF THE INVENTION

1. Field of the Invention

This relates to a method for producing a print-out image which is resistant to background print-up comprising imagewise exposure of a certain internally sensitive photographic silver halide material containing an electron-accepting agent, to illumination having an intensity greater than about 3 watts per square centimeter. One aspect of the invention is a method for producing a print-out image as described in which the photographic material, after imagewise exposure, may be surface developed by means of a surface developer or internally developed by means of an internal developer.

2. Description of the State of the Art

It is well known that photographic silver halide materials for image recording are of two types: developing-out and print-out. The developing-out type of photographic silver halide requires that the imagewise exposed photographic silver halide material be chemically or physically developed, and then fixed and washed to provide a stable, visible image. The print-out type photographic silver halide requires no chemical processing and may or may not be stabilized and fixed. These print-out materials generally have a much slower photographic speed than developing-out photographic materials. Moreover, the images from a print-out photographic silver halide material have encountered a problem following imagewise exposure. This problem involves the instability of the background areas of the resulting image. After print-out the instability results in obliteration of the image by background density increases as a function of time, ambient illumination and other conditions. It has been desirable to provide a process for providing print-out images in a photograhic silver halide material which produces increased resistance to background print-up following imagewise exposure.

Print-out direct positive images have been obtained by exposure of a silver bromide photographic emulsion which contained an electron-accepting compound and have been uniformly fogged to a visible density. Such materials are described in, for example, U.S. Pat. No. 3,650,758 of Gilman, issued Mar. 21, 1972. While such print-out silver halide materials, which are also known as bleach-out materials, are useful for providing a direct positive print-out image in some uses, these materials have not provided the degree of stability that is desired in many uses.

Photosensitive silver halide emulsions that contain internally fogged photosensitive silver halide also are well known. For example, a photosensitive emulsion containing internally fogged photosensitive silver halide grains having substantially no surface fog on the grains can be prepared, such as described in U.S. Pat. No. 3,271,157, by mixing a silver salt solution with a halide solution in a liquid reaction medium wherein the silver salt solution contains a certain percent of iodide per mole of silver and a certain amount of a thioether silver halide solvent. The resulting emulsion can be useful for forming direct positive or negative images. The emulsions are especially useful because they enable use of surprisingly high concentrations of sensitizing dye on the silver halide grains. However, no indication is given that the emulsions can be useful for forming print-out images that have high resistance to background degradation following imagewise exposure.

There has accordingly been a continuing need to provide a method for producing improved print-out images with photographic silver halide materials which are resistant to background print-up.

SUMMARY OF THE INVENTION

It has been found according to the invention that print-out images which have increased resistance to background print-up can be produced in a photosensitive silver halide material by (1) imagewise exposure of a photographic element comprising a support having thereon at least one photosensitive silver halide emulsion comprising: (a) photosensitive silver halide grains in which the sensitivity sites where latent image can be formed on light exposure are predominantly inside the silver halide grains; and (b) at least one electron-accepting compound having a polarographic reduction potential within the range of about −0.8 volt to about −0.01 volt, the exposure being to illumination having an intensity sufficient to provide a visible print-out image, such as an intensity greater than about 3 watts per square centimeter.

Also, according to the invention, the described photographic material may be given the described imagewise exposure and then surface developed, typically with a surface developer; or, if there has been subsequent ambient light exposure, the resulting image can be internally developed with an internal developer. Surprisingly stable images are provided.

The preferred photosensitive silver halide in the described method according to the invention consists essentially of photosensitive silver halide which has been internally fogged.

The described electron-accepting compounds are preferably those within the described polarographic reduction potential range and are selected from the group consisting of phenazine dyes, arylidene dyes, merocyanine dyes, cyanine dyes, azacyanine dyes, pyrylium dyes, imidazo[4,5-b]quinoxalinium salts and bipyridinium salts.

The described method for producing a print-out image which is resistant to background print-up is especially advantageous because in its simplest form no processing solutions are required and the process can be carried out with room light handling capability after the image exposure.

DETAILED DESCRIPTION OF THE INVENTION

A variety of print-out photosensitive silver halide materials are useful in the described method. Also a variety of electron-accepting compounds, also described herein as desensitizing compounds, are useful in the method. The exact mechanism by which the stable print-out image is produced is not fully understood. However, it is believed the desensitizing compounds, as described, trap photoelectrons generated by normal light exposure and prevent them from moving to a site on or in the silver halide grain where they can contribute to the formation and growth of latent image specks. It is speculated that an imagewise high intensity exposure according to the described process of the invention produces photoelectrons in such numbers in the image areas that the capacity of the desensitizer to trap them is exceeded. The excess electrons, it is believed, generate or aid the growth of latent image silver specks, just as they would in a silver halide emulsion with no desensitizer present. Once this exposure to high intensity has ended, the desensitizing compounds, it is believed, continue to function as electron traps in non-image areas rendering the silver halide insensitive to any further ambient illumination. Apparently, the latent image specks on the surface of the silver halide form and grow during the described intense imagewise exposure to such an extent that the image is visible without further processing. Thus, a print-out image is formed.

The resulting image, which is visible, can be viewed in room light or daylight without print-up occurring in the non-image areas. However, the silver specks which formed in the image areas during the intense imagewise exposure continue to grow under ambient illumination conditions. For this reason, while viewing the resulting print-out image in room light, the image can be expected to continue to increase in maximum density.

Another aspect of the described method of the invention is that the latent image produced by high intensity exposure as described but kept from any low intensity exposure, can be developed to a strong image in a conventional surface developer.

In still another aspect of the described process of the invention, if the latent image produced by the described high intensity exposure is even briefly exposed to low intensity light such as room light, and then developed in a surface developer, no image is produced. If it is developed in an internal developer, a strong image is produced. This result is very surprising. The low intensity exposure, it is speculated, bleaches the surface image and the internal fog but not the internal latent image produced by the high intensity exposure.

The print-out photosensitive silver halides which are useful in the process of the invention include silver bromide, silver bromoiodide, silver chlorobromoiodide and the like or mixtures thereof. However, the halide of the photosensitive silver halide is preferably at least 50 mole percent bromide. For certain embodiments the halide of the photosensitive silver halide can contain up to about 10 mole percent iodide. A wide range of silver halide grain size is useful, from coarse grain to fine grain. The silver halide can be prepared by any of the procedures useful for preparing photosensitive silver halide emulsions designed for print-out purposes. A typical photosensitive silver halide emulsion, containing internally fogged photosensitive silver halide grains and having substantially no surface fog on the grains, which is useful in the described process is one in which the silver halide is prepared by mixing a silver salt solution with a halide solution in a liquid reaction medium wherein the silver salt solution contains about 0.5 to about 7.0 mole percent iodide per mole of silver and mixing is carried out in the presence of at least 0.5 grams of a thioether silver halide solvent per mole of silver in the liquid reaction medium. Such a photosensitive silver halide emulsion is described in, for example, U.S. Pat. No. 3,767,413 of Miller, issued Oct. 23, 1973.

The photosensitive silver halide is primarily an internal image photosensitive silver halide. Typically such internal image silver halide materials are those which, when measured according to conventional photographic techniques by coating a test portion of the silver halide material on a transparent support, exposing to a light intensity scale having a fixed time between $1\times10^{-6}$ and one second, bleaching five minutes in a 0.3% potassium ferrocyanide solution at 65° F. (18° C.) and developing for about five minutes at 65° F. (18° C.) in an internal type developer (such as described in U.S. Pat. No. 3,178,292 of Fix, issued Apr. 13, 1965), have a sensitivity, measured at a density of 0.1 above fog, greater than the sensitivity of an identical test portion which has been exposed in the same way and developed for six minutes at 68° F. (20° C.) in a surface type developer, described in, for example, U.S. Pat. No. 3,178,292 of Fix, issued Apr. 13, 1965.

The photosensitive silver halide useful in the described method of the invention is typically monodispersed. Such monodispersed silver halide materials have typically no more than about 25% by weight of the silver halide smaller than the mean grain size and no more than about 25% by number of the silver halide grains larger than the mean grain size. Such monodispersed photosensitive silver halide materials are known in the photographic art and can be prepared by known procedures.

A variety of silver halide peptizers can be useful in preparing the described photosensitive silver halide. While the peptizer is typically gelatin, a gelatin derivative or a protein peptizer, other silver halide peptizers are useful such as cellulose derivatives, polysaccharides and the like as well as synthetic polymeric peptizers, such as vinyl polymers known to be useful as peptizers.

The concentration of peptizer useful in preparing silver halide as described is typically within the range of about 10 grams to about 100 grams of the described peptizer per liter of solvent, such as per liter of water.

The described photosensitive silver halide emulsions useful in the described process can contain a variety of colloids, alone or in combination, as vehicles or binding agents and in various layers. Suitable hydrophilic materials include both naturally-occurring substances, such as proteins, for example, gelatin, gelatin derivatives, cellulose derivatives, polysaccharides such as dextran, gum arabic and the like, and synthetic polymeric substances such as water soluble polyvinyl compounds like poly(vinyl pyrrolidone), acrylamide polymers and the like.

The photosensitive silver halide materials, and layers of a photographic element useful according to the described process, can contain, alone or in combination, with the hydrophilic colloids, other synthetic polymeric compounds such as dispersed vinyl compounds, such as in latex form and particularly those which increase the dimensional stability of the photographic materials useful in the described process. These synthetic materials are known in the art and include such effective compounds as water insoluble polymers or latex copolymers of alkyl acrylates and methacrylates, acrylic acid, sulfoalkyl acrylates or methacrylates and those which have cross-linking sites which facilitate hardening or curing.

The concentration of photosensitive silver halide in an element useful in the described process can vary depending upon such factors as the desired image, other addenda in the photographic element, the intensity of the described imagewise exposure, post-processing steps or conditions, and the like. The concentration of photosensitive silver halide is typically within the range of about 0.002 to about 0.1 moles of silver per square meter of support of an element useful in the described process.

The photosensitive silver halide that is useful in the described process can be one which is prepared with a conventional ripening step but which is not chemically sensitized. That is, the photosensitive silver halide can be what is described as a "primitive" silver halide emulsion. Alternatively, the photosensitive silver halide can be chemically sensitized using chemical sensitization procedures known in the photographic art. For example, the photosensitive silver halide can be both ripened using conventional silver halide emulsion technology and subsequently chemically sensitized, using conventional chemical sensitization procedures known in the photographic art.

The photographic layers and other layers of a photographic element useful in a process as described can be on a wide variety of supports. Typical supports include cellulose ester film, poly(vinyl acetal) film, polystyrene film, poly(ethylene terephthalate) film, polycarbonate film and related films or resinous materials, as well as glass, paper, metal and the like. Typically, a flexible support is most useful, especially a paper support.

A variety of electron-accepting compounds, also described herein as desensitizers, can be useful with the described photosensitive silver halide in the process according to the invention. The electro-accepting compound has a polarographic reduction potential within the range of about −0.8 volt to about −0.01 volt. Especially useful electron-accepting compounds can be selected from the group consisting of phenazine dyes, arylidene dyes, merocyanine dyes, cyanine dyes, azacyanine dyes, pyrylium dyes, imidazo[4,5-b]quinoxalinium salts and bipyridinium salts. Examples of such compounds include phenazine dyes, such as 1,3-diamino-5-methyl-5H-phenazinium chloride; 3,7-diamino-6-phenyl-5H-phenazinium chloride; arylidene dyes, such as 5-(3-nitrobenzylidene)rhodanine; merocyanine dyes, such as 3-[(3-ethyl-5-nitro-2-benzothiazolinylidene)ethylidene]pyrido[1,2-a]pyrimidine-2,4-thione, 3-[(6-chloro-1,3-diphenyl-1H-imidazo-[4,5-b]quinoxalin-2(3H)-ylidene) ethylidene]pyrido[1,2-a]pyrimidine-2,4-thione; cyanine dyes, such as 1-methyl-3-[3-(1-methyl-2-phenyl-3-indolyl)prop-2-en-1-ylidene]-2-phenylindolium bromide, 1,1',3,3,3'-hexamethyl-5,5'-dinitroindocarbocyanine para-toluenesulfonate, anhydro-6,6'-dinitro-3,3'-bis(3-sulfopropyl)-thiacyanine hydroxide, sodium salt; azacyanine dyes such as 3-[2-(3-ethyl-6-nitro-2-benzothiazolinylidene)-1-azaethylidene]-1-methyl-2-phenylindolium iodide; pyrylium dyes, such as 3-methyl-3-nitro-4',6'-di-phenyl-3',10-trimethyleneoxa-2'-pyrrylocarbocyanine perchlorate, 2',2'-di-tert-butyl-3-ethyl-6-nitro-4'-pyrrylothiacarbocyanine perchlorate; imidazo[4,5-b]quinoxalinium salts, such as 1,3-diethyl-2-[2-(1-methyl-2-phenyl-3-indolyl)vinyl]imidozolo-[4,5-b]quinoxalinium iodide; and bipyridinium salts such as 1,1-di-N-butyl-4,4'-bipyridinium dibromide, and the like.

The method of determining the described polarographic reduction potential is known in the art. An especially useful method for determining the described polarographic reduction potential range is described in: R. F. Large, "The Use of Electrochemical Data in Studies of Spectral Sensitization" in *Photographic Sensitivity,* R. J. Cox, editor, pages 243–245, Academic Press, 1973.

An especially useful electron-accepting compound which can be on the described silver halide useful in the described process is 1,1-di-N-butyl-4,4'-bipyridinium bromide.

The concentration of the electron-accepting compound on the described photosensitive silver halide that is useful in the process according to the invention can be within a concentration range of about 1 to about 1000 milligrams of the electron-accepting compound per mole of silver in the silver halide. The optimum concentration of electron-accepting compound will vary depending upon such factors as the desired image, the intensity of the imagewise exposure, storage conditions and the like.

The electron-accepting compound can be added to the described photosensitive silver halide at any useful stage in the silver halide emulsion preparation. Typically, it is added at one of the final stages in the preparation of the silver halide.

In the process of the invention, the light source useful for the described imagewise exposure must generate an intensity of at least about 3 watts per square centimeter at the desired level of electron-accepting compound. It is believed that below this level the rate of generation of photoelectrons is not sufficient to exceed the capacity of the electron-accepting compound to inactive them. The length of exposure is variable. It is believed important at some time during the exposure to provide the desired image to reach at least the intensity at which the rate of photoelectron generation will exceed the rate of photoelectron trapping by the described electron-accepting compound. The optimum intensity of light required will vary with the quantity of electron-accepting compound present on the silver halide because the greater the amount of electron-accepting compound present, the greater the number of electrons which can be trapped; therefore, the greater the exposure intensity must be to generate an excess of electrons. Conversely, the lower the concentration of the electron-accepting compound is on the silver halide, the lower the intensity threshold of imagewise exposure can be. The minimum concentration of electron acceptor which must be present is a concentration that is sufficient to reduce print-up in the background areas of the element due to ambient illumination following the imagewise exposure.

The electron acceptor and the concentration of electron acceptor can vary within the described parameters. It is especially useful when a chemically sensitized photosensitive silver halide is to be used that the electron acceptor have a polarographic reduction potential within the range of about −0.8 volt to about −0.01 volt. It has been determined that electron-accepting compounds which, on the described photosensitive silver halide in the described process, have a polarographic reduction potential more negative than −0.8 volt, with the photosensitive silver halide being a "primitive" emulsion, i.e., not chemically sensitized, do not produce a useful print-out image which has the desired degree of resistance to background print-up.

The photosensitive silver halide materials useful according to the described process can contain a variety of addenda which do not adversely affect the desired print-out image. Such addenda are described, for example, in paragraphs III–VIII and IX–XVI in the *Product Licensing Index,* Volume 92, December 1971, Publication 9232, pages 107–110, published by Industrial Opportunities Ltd., Homewell, Havant, Hampshire, PO9 1EF, UK.

Ambient illumination conditions as described herein is intended to refer to light which is part of the normal day-to-day environment, such as normal room illumination, daylight, and also direct sunlight. The method according to the invention produces a print-out image which is resistant to background print-up under such ambient illumination conditions.

A variety of means can be useful for producing the described light intensity imagewise exposure to provide a print-out image according to the described process. The high intensity exposure means must be sufficient to provide the desired intensity greater than 3 watts per square centimeter. For long exposures, typically photoflood lamp exposures, the intensity should be greater than direct sunlight. A typical exposure means is one which provides a high intensity flash such as is available from an Ascor electronic flash having a light energy of $2.1\times10^{-1}$ coulombs per second. (The Ascor electronic flash unit is a commercially available high intensity exposure means available from The Ascor Corporation).

Another embodiment of the invention is a method of producing an intensified print-out image which is resistant to background print-up comprising, respectively, imagewise exposure as described followed by surface development with a surface developer. The surface development can be by means of a surface developer such as described in U.S. Pat. No. 3,178,292 of Fix, issued Apr. 13, 1965. Such a developer can consist essentially of the following components: N-methyl-p-aminophenol sulfate; sodium sulfite, desiccated; hydroquinone; sodium carbonate, desiccated; potassium bromide; citric acid; potassium metabisulfite; and water to make 1 liter. Other surface bleaching compositions, especially other surface developers, are known in the photographic art and can be useful.

Another embodiment of the invention is a method for producing in a photographic silver halide element an intensified print-out image which is resistant to background print-up comprising, respectively, (1) imagewise exposure of a photographic element comprising a support having thereon at least one photosensitive silver halide emulsion comprising: (a) photosensitive silver halide grains in which the sensitivity sites where a latent image can be formed on light exposure are predominantly inside the grains; and, (b) at least one electron-accepting compound having a polarographic reduction potential within the range of about −0.8 volt to about −0.01 volt, the exposure being to illumination having an intensity greater than about 3 watts per square centimeter; (2) exposing the element uniformly to illumination having an intensity less than about 3 watts per square centimeter and then (3) internally developing the resulting image by means of an internal developer.

The internal development as described can be useful with an internal developer, such as one consisting essentially of the following components: N-methyl-p-aminophenol sulfate; sodium sulfite, desiccated; hydroquinone; sodium carbonate, monohydrate; potassium bromide; sodium thiosulfate; and water to make 1 liter. Other internal developers known in the photographic art can also be useful for the described internal development.

The term "intensified" herein regarding a print-out image is intended to mean that the density of print-out image is greater than that density obtained by print-out exposure alone.

The following examples are included for a further understanding of the invention.

EXAMPLE 1—PRINT-OUT ACCORDING TO THE INVENTION

An internally-fogged photosensitive silver bromoiodide emulsion having an average grain size of about 1 micron was prepared by adding an aqueous 3.43 molar solution of potassium bromide (2720 milliliters) and an aqueous 2.76 molar solution of silver nitrate (3400 milliliters), containing 0.75 mole percent potassium iodide, simultaneously to 6500 milliliters of a rapidly agitated aqueous gelatin solution (6.2 weight percent gelatin) containing 1,10-dithia-4,7,13,16-tetraoxacyclooctadecane (10.3 grams) as a ripening agent, at a temperature of 50° C. over a period of 40 minutes at a pAg of 8.9. This method of preparing an internally fogged silver bromoiodide emulsion is described in, for example, U.S. Pat. No. 3,767,413 of Miller, issued Oct. 23, 1973.

After the photosensitive silver bromoiodide emulsion was washed, an electron-accepting compound that was 1,1-di-N-butyl-4,4'-bipyridinium dibromide was added to the emulsion at a concentration of 200 milligrams of the electron-accepting compound per mole of silver. The resulting emulsion was then coated on a poly(ethylene terephthalate) film support at 43.06 milligrams of silver per square decimeter and 107.6 milligrams of gelatin per square decimeter of support.

The resulting photosensitive element, under darkroom conditions, was imagewise exposed through a negative to a high intensive light flash from an Ascor electronic flash unit having a light energy of $2.1\times10^{-1}$ coulombs per second. The time length of flash was about $10^{-3}$ seconds. The intensity of the flash was greater than about 3 watts per square centimeter. A visible print-out image was immediately observed. The print-out image became darker upon exposure of the element to room light. Subsequent exposure of the element to room light for 5 days and exposure to bright sunlight for 5 hours produced no observable print-up in the background areas of the element.

A control photographic element prepared in a similar manner, as described, but without the described electron-accepting compound, formed a print-out image upon flash exposure. However, upon exposure of the photographic element to room lights for a few hours, the image was completely obliterated due to lack of resistance to background print-up.

EXAMPLES 2-9—PROCESSES FOR PRODUCING PRINT-OUT IMAGES ACCORDING TO THE INVENTION

Photographic elements with and without an electron-accepting compound were prepared as described in Example 1. Each of these elements was then imagewise exposed to a high intensity light flash as described in Example 1 and then processed as described in following Table I. The results of this process are given in Table I under the heading printout image.

Table I

| Example | Electron Accepting Compound | First Exposure Intensity | Second Exposure Intensity | Surface Developer Image | Internal Developer Image | Printout Image |
|---|---|---|---|---|---|---|
| 2 | none | low | none | negative | negative + fog | poor |
| 3 | none | high | none | negative | negative | negative + |

Table I-continued

| Example | Electron Accepting Compound | First Exposure Intensity | Second Exposure Intensity | Surface Developer Image | Internal Developer Image | Printout Image |
|---|---|---|---|---|---|---|
| | | | | | + fog | high background print-up |
| 4 | none | high | low | none | negative + fog | negative + high background print-up |
| 5 | none | low | high | none | fog | none |
| 6 | yes | low | none | none | direct positive | none |
| 7 | yes | high | none | negative | negative + fog | negative, no background print-up |
| 8 | yes | high | low | none | negative | negative, no background print-up |
| 9 | yes | low | high | none | negative | negative, no background print-up |

Table I illustrates in Example 8 that exposing the described photographic element containing the internally sensitive photosensitive silver halide and the described electron-accepting compound by exposure to a high intensity flash followed by a low intensity illumination and development in a surface developer produces no image. However, if an internal developer is used, a strong negative image can be produced. It is surprising that all of the surface image and internal fog is removed by the low intensity post exposure but none of the internal latent image produced from the flash exposure is removed.

A comparative example was run using a photosensitive silver halide emulsion as described in Example 2 of U.S. Pat. No. 3,703,584 of Motter, issued Nov. 21, 1972. To separate samples of the resulting photosensitive silver halide emulsion were added the following electron-accepting compounds: (a) 1,1',3-triethyl-1H-imidazo[4,5-b]quinoxalino-2'-carbocyanine (having a reduction potential of −0.89 volt) and (b) 1,3-diethyl-1'-methyl-2'-phenylimidazo[4,5-b]quinoxalino-3'-indolocarbocyanine iodide (reduction potential of −0.63 volt). The two photosensitive silver halide emulsion materials were coated on a film support and then each was exposed imagewise to a flash of light from an Ascor electronic flash unit to provide a print-out image in each element. The photographic element containing electron-acceptor (a) under room light exposure printed up in the background areas while the photographic element containing the electron-acceptor (b) did not.

The invention has been described in detail with particular reference to preferred embodiments thereof, but it will be understood that variations and modifications can be effected within the spirit and scope of the invention.

What is claimed is:

1. In a method for producing a print-out image in a photographic element which comprises a support having thereon at least one photosensitive silver halide emulsion, by imagewise exposure of said element to illumination, the improvement wherein: (I) said photosensitive silver halide emulsion comprises silver halide grains in which the sensitivity sites where latent image can be formed on light exposure are formed by chemically internally fogging said grains and said sites are predominantly inside the grains; and, said silver halide grains having on the surface thereof at least one electron-accepting compound having a polarographic reduction potential within the range of about −0.8 volt to about −0.01 volt; and, (II) said imagewise exposure is to illumination having an intensity greater than about 3 watts per square centimeter; whereby a print-out image is obtained which is resistant to background print-up.

2. A method for intensifying a print-out image obtained in accordance with claim 1 which comprises surface developing said print-out image by means of a surface developer, prior to exposing said element to ambient light.

3. A method for producing in a photographic silver halide element an intensified print-out image which is resistant to background print-up comprising, respectively, (1) imagewise exposure of a photographic element comprising a support having thereon at least one photosensitive silver halide emulsion comprising: (a) photosensitive silver halide grains in which the sensitivity sites where a latent image can be formed on light exposure are formed by chemically internally fogging said grains and said sites are predominantly inside the grains; and, (b) at least one electron-accepting compound having a polarographic reduction potential within the range of about −0.8 volt to about −0.01 volt, the exposure being to illumination having an intensity greater than about 3 watts per square centimeter; whereby a print-out image is obtained which is resistant to backgrond print-up; (2) exposing the element uniformly to illumination having an intensity less than about 3 watts per square centimeter; and then (3) internally developing the resulting image by means of an internal developer; whereby an intensified print-out image is produced.

4. The method of claim 1 in which the photosensitive silver halide grains of said element are internally fogged by means of a thioether silver halide solvent.

5. The method of claim 1 wherein the electron-accepting compound is selected from the group consisting of phenazine dyes, arylidene dyes, merocyanine dyes, cyanine dyes, azacyanine dyes, pyrylium dyes, imidazo[4,5-b]quinoxalinium salts and bipyridinium salts.

6. The method of claim 1 wherein the electron-accepting compound is a bipyridinium salt.

7. The method of claim 1 wherein the electron-accepting compound is 1,1-di-N-butyl-4,4'-bipyridinium dibromide.

8. The method of claim 1 wherein the electron-accepting compound is present on the photosensitive silver halide grains within a concentration of about 1 to about 1000 milligrams of the electron-accepting compound per mole of silver.

* * * * *